United States Patent [19]

Sessoms

[11] Patent Number: 4,497,142

[45] Date of Patent: Feb. 5, 1985

[54] BUSH AX SHARPENING HOLDER AND METHOD OF RETAINING

[76] Inventor: L. A. Sessoms, Rte. 1, Box 63-A, Clarkton, N.C. 28433

[21] Appl. No.: 461,589

[22] Filed: Jan. 27, 1983

[51] Int. Cl.[3] ..... B24B 19/00

[52] U.S. Cl. ..... 51/218 R; 76/82

[58] Field of Search ..... 51/218 R, 218 A; 76/82; 30/169

[56] References Cited

U.S. PATENT DOCUMENTS

| | | | |
|---|---|---|---|
| 1,207,212 | 12/1916 | Purcell | 76/82 |
| 1,339,725 | 5/1920 | Stoke | 76/82 |
| 1,349,178 | 8/1920 | Wiggs | 76/82 |
| 1,878,439 | 9/1932 | Daude | 76/82 |
| 1,927,202 | 9/1933 | Burdick | 30/169 |
| 2,437,779 | 3/1948 | Carpentier | 51/218 R |
| 2,685,156 | 8/1954 | Anderson | 76/82 |
| 3,800,632 | 4/1974 | Juranitch | 76/82 |

FOREIGN PATENT DOCUMENTS

| | | | |
|---|---|---|---|
| 438124 | 5/1952 | Canada | 76/82 |

*Primary Examiner*—Harold D. Whitehead
*Attorney, Agent, or Firm*—Mills & Coats

[57] ABSTRACT

The present invention relates to a bush ax sharpening holder that is adapted to receive and support a bush ax while the same is being sharpened. The bush ax sharpening holder includes an elongated main body structure in the form of a U-shaped channel with opposed open ends. Formed about one open end is a pair of elongated parallel slots. The slots are designed to receive the bush ax blade, and the main body structure is designed such that a handle receiving area is defined through a portion of the main body structure. A blade tightener is threaded into the lower portion of the main body structure and is adapted to be screwed into engagement with the bush ax blade so as to press the blade into a binding relationship with the slots. This serves to firmly hold the bush ax in place in order that the cutting edge thereof, which lies outside of the main body structure of the bush ax sharpening holder, can be sharpened. In addition the bush ax sharpening holder is designed to be mounted to a support structure such as a vehicle bumper.

2 Claims, 7 Drawing Figures

BUSH AX SHARPENING HOLDER AND METHOD OF RETAINING

FIELD OF INVENTION

The present invention relates to blade holders and more particularly to blade holders for holding blades during sharpening.

BACKGROUND OF THE INVENTION

The bush ax is a most useful hand cutting tool for cutting and chopping weeds and vegetation along ditch banks and other areas where a power driven cutter cannot be maneuvered.

But with bush axes and other similar cutting tools, it is difficult and sometimes inconvenient to sharpen them. First, the need for sharpening often occurs in remote locations, far from a shop or other facility where a vice or other type of tool holder is located. This requires an individual to hold and support the bush ax or cutting tool while sharpening the same. Besides being unsafe and dangerous, this method of sharpening is often very inefficient and ineffective.

Further, there is a need for a tool holder that is specifically designed to receive and support a cutting tool such as a bush ax while the same is being sharpened. Generally one will often use a vice or some other type of tool holder to secure a bush ax during the sharpening process. But often such devices, because they are not properly designed to receive and support cutting tools such as bush axes, are not easy to use and do little to facilitate the sharpening of the tool. In addition conventional tool holders of the type required for receiving and supporting such a cutting tool as a bush ax are not portable and adapted to be carried from one location to another. Consequently there is a real need for a tool holder that is specifically designed as a sharpening tool holder for receiving and supporting a cutting tool such as a bush ax while the same is being sharpened.

SUMMARY AND OBJECTS OF THE INVENTION

The present invention relates to a method and apparatus for sharpening a bush ax. The apparatus includes an elongated U-shaped tool holder that includes opposed open opposite ends. About one open end there is provided a pair of parallel slots for receiving a blade such as a bush ax blade. Secured in the bottom of the U-shaped holder underneath the slots is a threaded blade tightener screw. Once a blade has been inserted in the slots, the blade tightener screw can be screwed such that the same engages one side of the blade and causes the blade to be firmly bound within the slots. Once this has been accomplished, the cutting edge of the blade extends outwardly from the slots and outwardly from the U-shaped tool holder itself and as such assumes a position that enables the blade to be sharpened.

The U-shaped blade holder of the present invention is designed for portability and is adapted to be mounted to various types of support structures, including the bumper of a vehicle. Therefore, it is appreciated that the blade holder of the present invention can be transported from one location to another and would accordingly be available for convenient use by road crews cutting weeds and other vegetation along highway ditch banks.

It is, therefore, an object of the present invention to provide a tool holder that is specifically designed to receive and support the blade of a cutting tool for sharpening.

Another object of the present invention resides in the provision of a sharpening holder for a bush ax type cutting tool.

Another object of the present invention is to provide a sharpening holder for a bush ax that is adapted and designed to be mounted to a support structure such as a bumper of a vehicle in order that the same can be readily accessible to road crews and the like that are cutting weeds and vegetation along highway ditch banks.

It is also an object of the present invention to provide an apparatus for sharpening a cutting tool such as a bush ax wherein an apparatus entails sandwiching the blade portion of the cutting tool between two elongated slots and binding the blade within the slots such that the cutting edge extends outwardly therefrom and is easily accessible for sharpening purposes.

A further object of the present invention resides in the provision of a blade holding device for supporting and holding a bush ax for sharpening that is adapted to be mounted to the bumper of a vehicle.

A further object of the present invention resides in the provision of a blade holder for retaining a blade while the same is being sharpened that is safe and which enables the blade to be efficiently and effectively sharpened.

Still a further object of the present invention resides in the provision of a blade sharpener holder that is designed such that the blade to be sharpened can be quickly inserted and removed from the holder.

It is also an object of the present invention to provide a blade sharpening holder that is of a rugged design and which will be relatively free of maintenance and upkeep.

Another object of the present invention is to provide a blade sharpening holder that is specifically designed to receive and support a bush ax, and which includes a provision for accepting an elongated handle extending from the blade of the bush ax.

Other objects and advantages of the present invention will become apparent from a study of the following description and the accompanying drawings which are merely illustrative of such invention.

BUSH AX SHARPENING HOLDER

Figure 1:
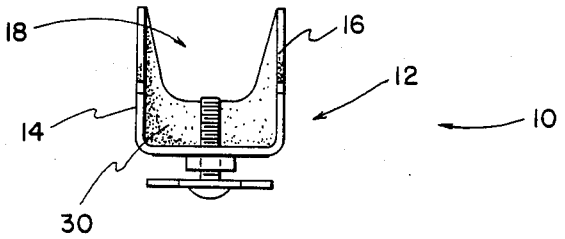
FIG. 1 is an end elevational view of the blade sharpening holder of the present invention.
Figure 2:
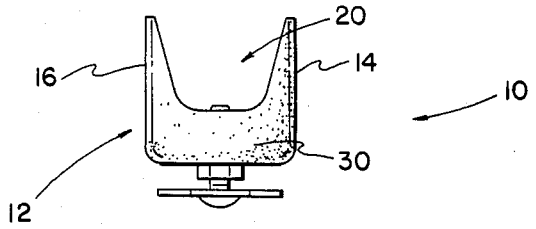
FIG. 2 is an end elevational view of the blade sharpening holder of the present invention viewing the same from the end opposite that shown in FIG. 1.
Figure 3:
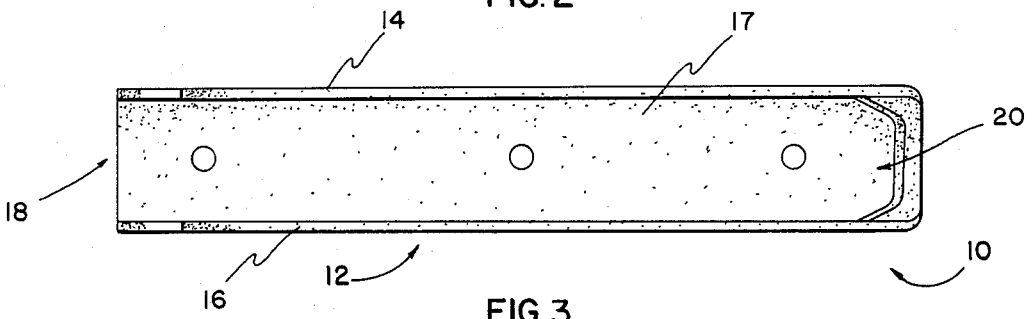
FIG. 3 is a top plan view of the blade sharpening holder of the present invention.
Figure 4:
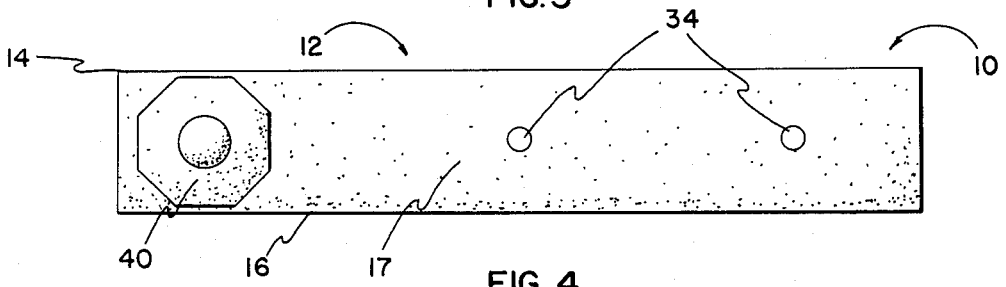
FIG. 4 is a bottom plan view of the blade sharpening holder of the present invention.
Figure 5:
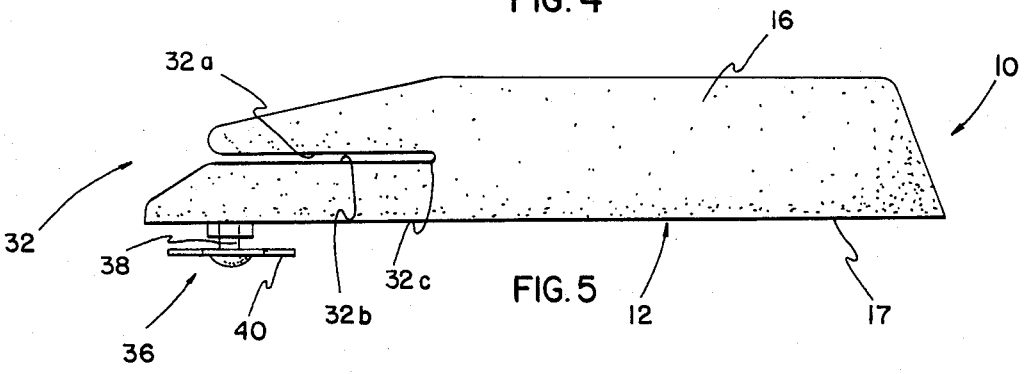
FIG. 5 is a side elevational view of the blade sharpening holder of the present invention.
Figure 6:
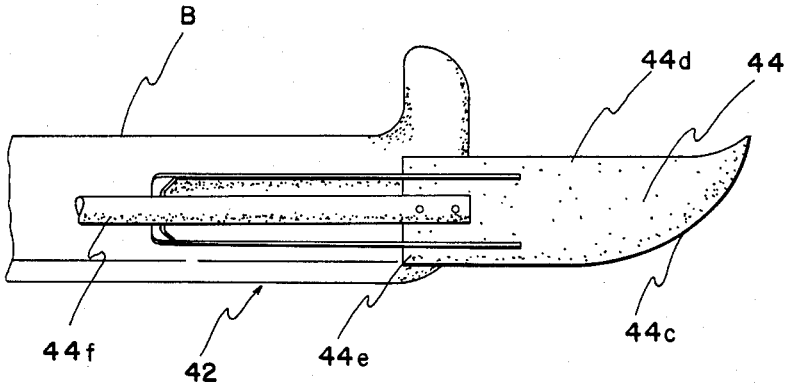
FIG. 6 is a top plan view of the blade sharpening holder of the present invention illustrating the same mounted on the bumper of a vehicle.
Figure 7:
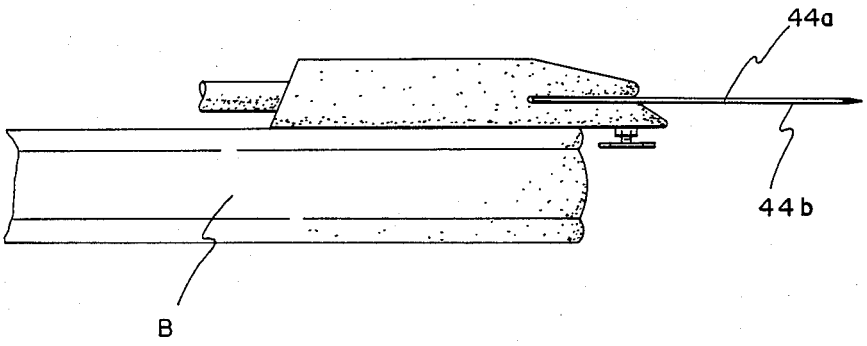
FIG. 7 is a side elevational view of the blade sharpening holder of the present invention showing the same mounted to the bumper of a vehicle.

With further reference to the drawings, the bush ax sharpening holder of the present invention is shown therein and indicated generally by the numeral 10.

Viewing bush ax sharpening ax holder 10 in more detail, it is seen that the same includes a generally U-shaped main body structure, indicated generally by the numeral 12. U-shaped main body 12 includes a pair of laterally spaced upstanding sides 14 and 16, and a bottom 17. A pair of open ends 18 and 20 are formed about opposite ends of main body 12. About one end, although generally open, there is provided a generally U-shaped reinforcing transverse member 30 that connects the two sides 14 and 16 with bottom 17.

About open end portion 18 there is provided a pair of elongated and parallel disposed slots indicated generally by the numeral 32. Slots 32 are formed in each of the sides 14 and 16 and extend from the open end 18 of the main body 12 towards the opposite end where they terminate after a predetermined distance. Each of the slots in the respective sides 14 and 16 include an upper runner edge 32*a* and a lower runner edge 32*b*. Where the respective slots 32 terminate, there is formed a back edge 32*c*.

Secured within bottom 17 of main body structure 12 is a blade tightener indicated generally by the numeral 36. Blade tightener 36 includes a threaded shaft 38 that is actually secured within bottom 17 of main body structure 12. Secured to the lower end of shaft 38 is a hexagon head screw cap 40.

The bush ax sharpening holder 10 is specifically designed to receive and support a bush ax while the same is being sharpened. To better appreciate the structure of a bush ax, reference is made to the drawings where a conventional bush ax is shown therein and indicated generally by the numeral 42. Such a bush ax entails a blade 44 that includes opposite sides 44*a* and 44*b*, a cutting edge 44*c* that extends from the upper portion of the blade 44 and curves across the top of the blade and extends down one side thereof, a back blade edge 44*d*, and a lower edge 44*e*. Extending from the bush ax blade is an elongated handle 44*f*.

In operation bush ax sharpening holder 10 is secured to a structure such as a bumper B of a vehicle. Main body 12 includes mounting means for mounting the same to a support structure such as bumper B. As seen in the drawings, the mounting means includes a pair of openings 34 formed in bottom 17 of the main body structure 12. To secure main body 12 to the bumper B, a pair of bolt assemblies are used and extend through openings 34 into appropriate openings formed in bumper B. Although blade sharpening holder 10 can be mounted at various locations on the bumper B, it is preferable that the same be mounted about an end portion of the bumper B. As illustrated in the drawings, the bush ax 42 is inserted into blade sharpening holder 10 such that the blade 44 is held within slots 32.

As seen in the drawings, the lower edge 44*e* of blade 44 abuts against the back edge 32*c* of slots 32. Also elongated handle 44*f* extends from blade 44 through the main body 12 between upstanding sides 14 and 16. Consequently the area between sides 14 and 16 is deemed a handle receiving area.

To secure blade 44 within the main body 12, blade tightener 36 is actuated. In this regard threaded shaft 38 is screwed towards one side of blade 44. Once threaded shaft 38 engages blade 44, the same continues to be screwed into engagement with the blade such that the blade is pushed upwardly into binding relationship with upper runner edge 32*a* of each of the slots 32. This firmly secures blade 44 within blade sharpening holder 10. It is appreciated that in this secure position the cutting edge 42*c* lies outside of the blade sharpening holder 10 and is consequently positioned for easy access for sharpening.

To remove blade 44 and bush ax 42 from blade sharpening holder 10, the blade tightener 36 is loosened so as to free blade 44 from the binding relationship within the blade sharpening holder.

From the foregoing discussion, it is appreciated that the present invention presents a blade sharpening holder 10 that is particularly designed to receive, support and hold a blade while the same is being sharpened. In addition blade sharpening holder 10 is specifically designed to receive and accommodate a conventional bush ax. Of particular significance to the present invention is the fact that the blade sharpening holder 10 is portable in design and can be secured to a variety of support structures, including the bumper B of a vehicle. This enables the blade holder to be conveniently used by highway crews cutting weeds and vegetation along highway ditch banks.

It is further appreciated that the present invention is relatively simple, and would be easy to manufacture.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A bush ax sharpening blade holder for receiving and supporting a bush ax of the type having an elongated handle and a blade projecting from said handle in a plane that extends parallel to the longitudinal axis of said handle, and wherein said bush ax holder is adapted to be mounted to a support structure such as a vehicle bumper for holding the bush ax during sharpening, said bush ax sharpening holder comprising in combination: an elongated main body in the form of a generally U-shaped channel structure having two laterally spaced upstanding elongated sides disposed in spaced apart relationship with respect to each other, a frame structure interconnecting said elongated sides of said U-shaped channel-like main body, and opposite open ends formed on opposite ends of the generally U-shaped channel structure; an elongated handle receiving area defined between said laterally spaced sides of said elongated main body for receiving said handle of said bush ax; mounting means operatively associated with said main body for securing said bush ax sharpening holder to a support structure such as a vehicle bumper; a pair of elongated slots formed in the upstanding sides of said main body and extending longitudinally along the said elongated sides from an open end of said main body a predetermined distance toward the opposite end where the slots terminate and define a blade stop, said slots being aligned and lying in a plane that extends parallel to the longitudinal axis of said handle when the same is disposed within said handle receiving area and held by said bush ax sharpening blade holder, whereby said bush ax blade can be received within said slots such that the cutting edge thereof will project outwardly from said bush ax sharpening holder wherein the same can be readily sharpened; and a screw type tightener threaded into the elongated main body and operable to be screwed into engagement with the bush ax blade so as to engage and press the blade into a binding relationship within said slots such that the blade is securely held within said elongated main body.

2. The bush ax sharpening holder of claim 1 wherein said elongated main body includes a bottom extending between said two laterally spaced sides, and wherein said screw type tightener is threaded within said bottom, and wherein said screw tight tightener is operative to be screwed upwardly into engagement with the bush ax blade held within said slots so as to bind said blade against the upper portion of the slots.

* * * * *